United States Patent [19]

Fischer

[11] 4,421,027

[45] Dec. 20, 1983

[54] MULTIPLE PRINTING MODE PRINTING MACHINE SYSTEM

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 360,068

[22] Filed: Mar. 22, 1982

[30] Foreign Application Priority Data

Apr. 25, 1981 [DE] Fed. Rep. of Germany ..... 3116505

[51] Int. Cl.[3] ..... B41F 11/00; B41F 5/24; B41F 7/36; B41L 25/14

[52] U.S. Cl. ..... 101/142; 101/148; 101/177; 101/179; 101/216; 101/352; 101/DIG. 28

[58] Field of Search ..... 101/DIG. 28, 42 S, 148, 101/147, 349–352, 136, 137, 141, 142, 177, 179, 180, 216, 217, 218, 220

[56] References Cited

U.S. PATENT DOCUMENTS

| | | | |
|---|---|---|---|
| 2,911,907 | 11/1959 | Davidson | 101/137 |
| 3,203,346 | 8/1965 | Norton et al. | 101/218 |
| 3,283,741 | 11/1966 | Brodie | 101/350 X |
| 3,793,952 | 2/1974 | Neumann et al. | 101/216 |
| 3,889,596 | 6/1975 | Thomas et al. | 101/352 X |
| 3,986,454 | 10/1976 | Granger | 101/177 |
| 4,222,325 | 9/1980 | Edwards | 101/148 X |
| 4,351,236 | 9/1982 | Beisel et al. | 101/148 |

FOREIGN PATENT DOCUMENTS

| | | | |
|---|---|---|---|
| 418437 | 10/1934 | United Kingdom | 101/142 |

*Primary Examiner*—Edgar S. Burr
*Assistant Examiner*—David A. Wiecking
*Attorney, Agent, or Firm*—Frishauf, Holtz, Goodman & Woodward

[57] ABSTRACT

To permit, selectively, lithographic printing, flexo printing, or direct lithographic printing on a printing machine with the same direction of rotation of the respective cylinders, a liquid application system (11) including a liquid application roller (15) is selectively positionable for engagement either with a plate cylinder (4, 5) of a lithographic system, the rubber blanket cylinder (2, 3) for direct lithographic printing, the plate cylinder then acting as a form ink transfer cylinder which is being continuously inked; or for engagement with the blanket cylinder, with a flexo printing plate applied to the blanket cylinder, and the plate cylinder being placed out of engagement with the blanket cylinder, the damping liquid for lithographic printing being replaced by flexo-printing ink, and the position (FIG. 3) being as close to the printing or impression line as possible, and between the zone of operation of the plate cylinder (4) and the printing cylinder (2) to prevent drying of the quick-drying flexo-printing ink.

8 Claims, 5 Drawing Figures

MULTIPLE PRINTING MODE PRINTING MACHINE SYSTEM

Reference to related application, assigned to the assignee of the present invention, the disclosure of which is hereby incorporated by reference: U.S. application Ser. No. 360,065, filed Mar. 22, 1982 by the inventor hereof, now U.S. Pat. No. 4,397,235, issued Aug. 9, 1983.

The present invention relates to a rotary printing machine system having at least one printing system retaining, within side walls thereof, a plate cylinder and a blanket cylinder, as well as an inker and a damper, and in which the damper can be selectively positioned to permit selectively different printing modes of operation.

BACKGROUND

A machine of a type to which the present invention relates is described in German Published Patent Application No. DE-AS 1 611 239. This machine can operate both in raised letters, or offset printing mode. The cylinders of the printing machine can operate in either direction, so that the paper path on which printing is to be effected can be suitably selected. The paper path is passed through the printing system which includes two plate cylinders and two blanket cylinders. In offset printing, the plate on the plate cylinder continuously has damping liquid applied thereto prior to inking thereof. For damping, a slinger-type damping system is provided, selectively positionable between two positions on the plate cylinger. When raised letter printing is to be effected, the slinger damping system is removed.

THE INVENTION

It is an object to expand the printing mode capability of a machine of the basic type as described to additionally permit operation of the machine utilizing flexo printing, that is, to permit, in dependence on printing job requirements, offset printing, direct lithographic printing or flexo printing.

Briefly, the damping system includes a trough in which a pickup roller dips, supplying liquid to a transfer roller for subsequent supply of liquid to an application roller. The damping system, selectively, can be placed in various working positions, for example by cooperating with the plate cylinder of an offset printing plate, with a blanket cylinder of a direct lithographic printing plate, or, in a third position with a flexo printing plate placed on the rubber cylinder, in which the plate cylinder then is disengaged from contact with the blanket cylinder, the trough of the damping system then being filled with flexo printing ink rather than with offset damping liquid, such as water.

The system has the advantage that the direction of movement of the respective cylinders need not be changed, that is, remains the same regardless of the type of printing mode which is selected. Thus, the invention is applicable to various types of machines, including those which are most simply constructed and can operate only in one direction of rotation. The invention is applicable both to sheet-fed printing machines as well as to paper web-fed machines, without structurally interfering with the basic arrangement of the machine.

DRAWINGS

Figure 1:
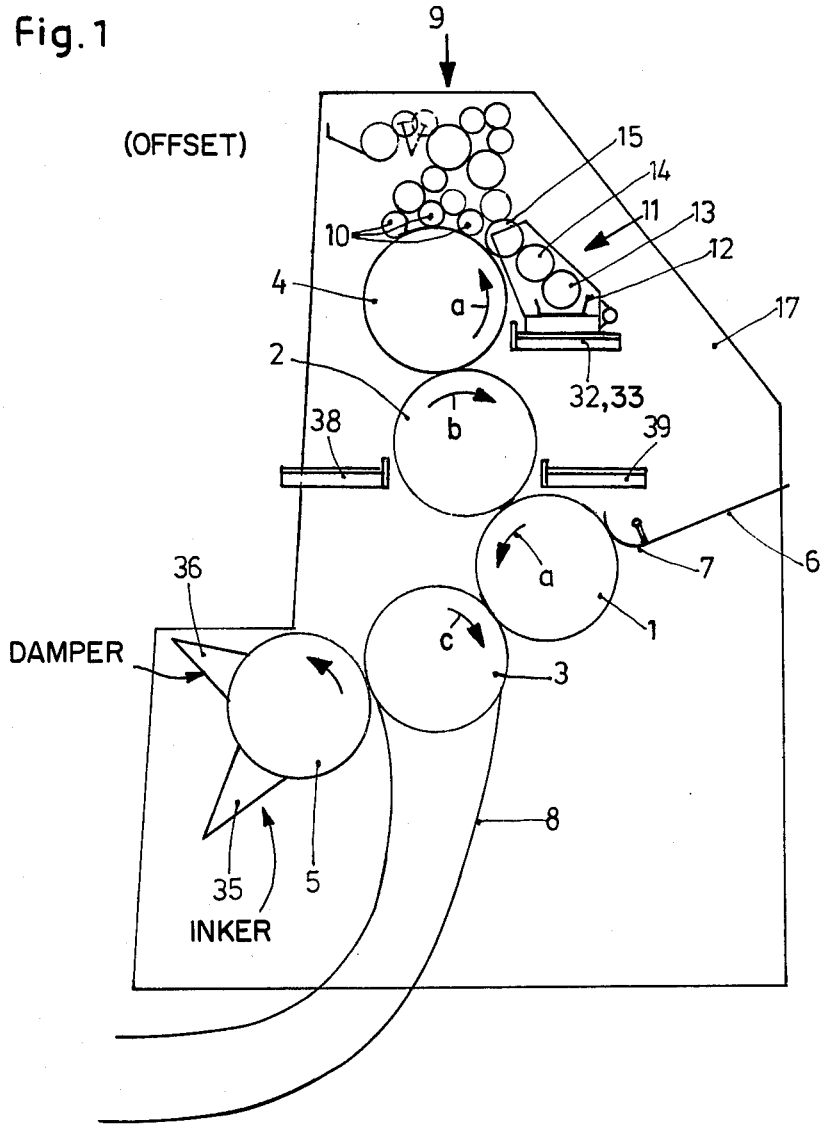
FIG. 1 is a schematic side view of a printing machine, arranged for standard offset printing.

The machine illustrated is capable of printing with two colors in offset mode. A make-ready table (FIG. 1) 6, having grippers 7, supplies a sheet of paper to the impression cylinder 1. One color of printed information is supplied from rubber blanket cylinder 2 and plate cylinder 4. The other color is supplied by a printing system including the rubber blanket cylinder 3 and plate cylinder 5. The sheet is transported out of the printing station by a transport chain system 8, formed with grippers (not shown). The respective grippers on the impression cylinder 1 likewise have been omitted for clarity of the drawings and may be in accordance with any standard construction.

An inker, generally shown at 9, and having a plurality of ink application rollers 10, is located in surface contact with the plate cylinder 4. It may be of any standard and suitable construction. Further, a damper 11 is provided which has a trough 12 of damping liquid in which a ductor roller 13 dips. The ductor roller 13 is in surface contact with a transfer roller 14. Transfer roller 14 may be axially oscillating. A liquid application roller 15 receives liquid from the roller 14 and applies it to the plate cylinder 4 in advance of ink applied by the application rollers 10.

Figure 4:
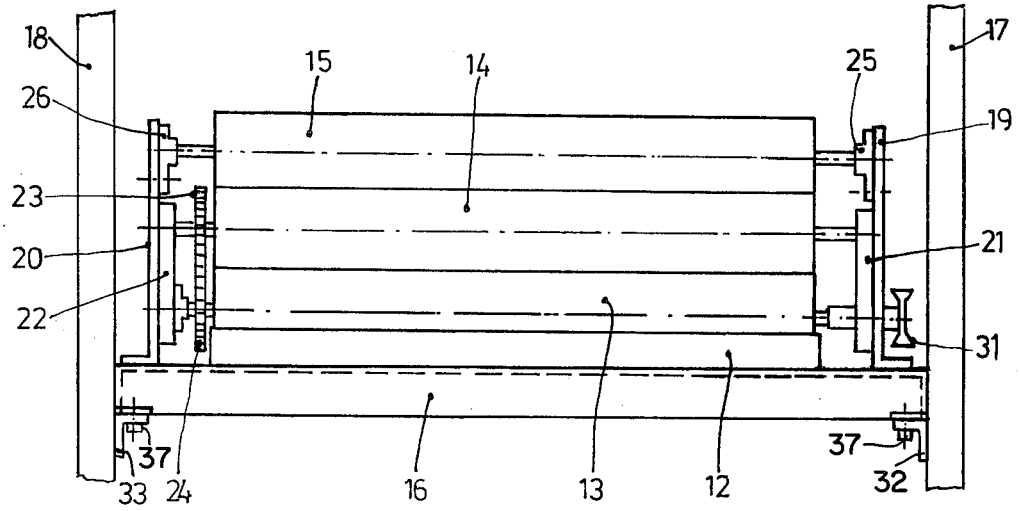
FIG. 4 is a fragmentary end view, partly cut away, of the damping system of the machine.
Figure 5:
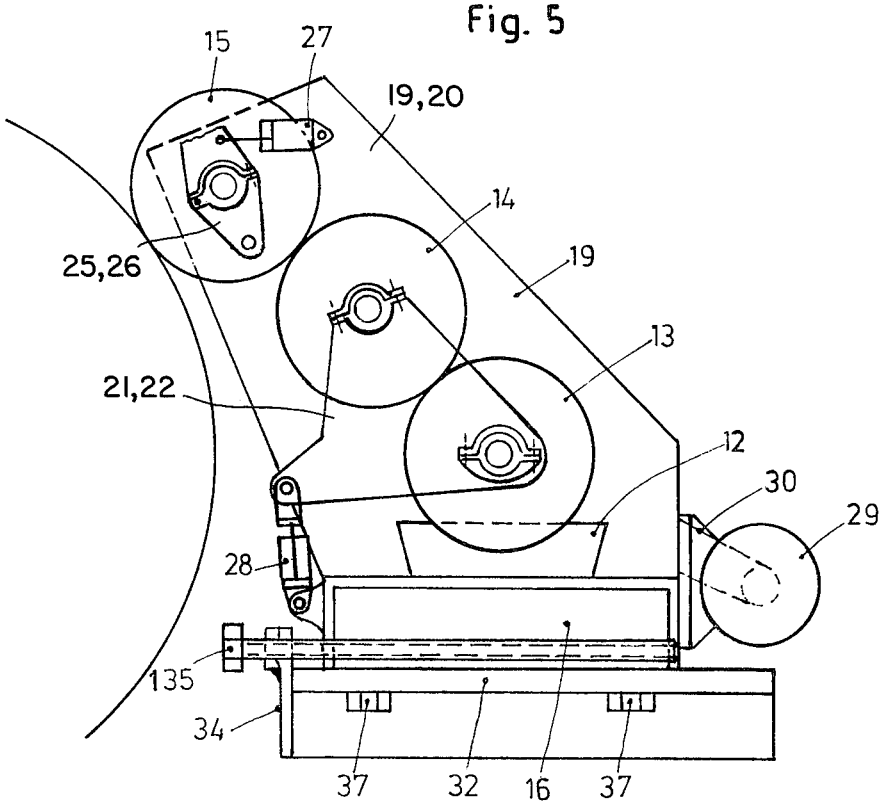
FIG. 5 is a schematic side view of the damping system of FIG. 4 shown to an enlarged scale.

The damper 11 is shown in greater detail in FIGS. 4 and 5. to which reference will be made: a carrier 16 is provided extending from one side wall 17 of the printing machine over to the side wall 18 (FIG. 4). Two plates 19, 20 are secured to the carrier 16. Plates 19, 20 extend parallel to the side wall 17,18. The plates 19, 20 retain two rocking links 21, 22, pivotable or swingable about the axis of rotation of the liquid pickup roller 13. The liquid pickup roller 13 and the transfer roller 14 are journalled between the links 21, 22 and are connected by gears 23, 24. Two further pivot links 25, 26 are located on the plates 19, 20, retaining the liquid application roller 15. The respective links are located in controlled position by hydraulic positioning elements 27, 28, for example cylinder-piston arrangements. By suitable application of hydraulic liquid, the application roller 15 and the transfer roller 14 can be placed, respectively, in quiescent or working position.

The support carrier 16 further supports an electric motor 29 which is connected by a belt drive 30 with a sheave 31, driving the pickup roller 13.

The carrier or support 16, and hence the damper 11, is secured in place at the inner surfaces of the side walls 17, 18 by being supported on support rails 32, 33 attached to the side walls, for example by welding. The ends of the support rails 32, 33 each are formed with a flange 34 through which an engagement bolt 135 is threaded in order to determine the correct position of the carrier 16 and with it the damper 11 with respect to the remaining cylinders and rollers of the printing machine. When properly positioned, the carrier 16 is secured in place on the machine by bolts 37, engaging through elongated holes or slots formed in the rails 32, 33.

A similar system is provided for the plate cylinder 5. The damper 36 and the inker 35 thereof are shown only schematically, since it may be identical to the arrangement of the damper 11 and the inker 9, or the mirror image thereof.

Operation, Offset Printing with Reference to FIG. 1: The damper 11 is secured on the carrier rails 32, 33. The damping liquid application roller is engaged on plate cylinder 4. Additionally, it may be in contact with one of the rollers of the inker 9 (see FIG. 1). Similarly, the inker 35 and the damper 36 are in engagement with the plate cylinder 5.

Upon starting of the machine, plate cylinders 4, 5 first have damping liquid applied thereto and thereafter they are inked. The printing information is transferred to the blanket cylinders 2, 3. Upon rotation in the direction of the arrow a of the impression cylinder, the sheet supplied by the grippers 7 from the make-ready table 6 is first printed by a first color ink by blanket cylinder 2 and, upon subsequent transfer of the sheet to the impression or printing line between impression cylinder 1 and blanket cylinder 3, printing with a second color ink is effected.

Figure 2:
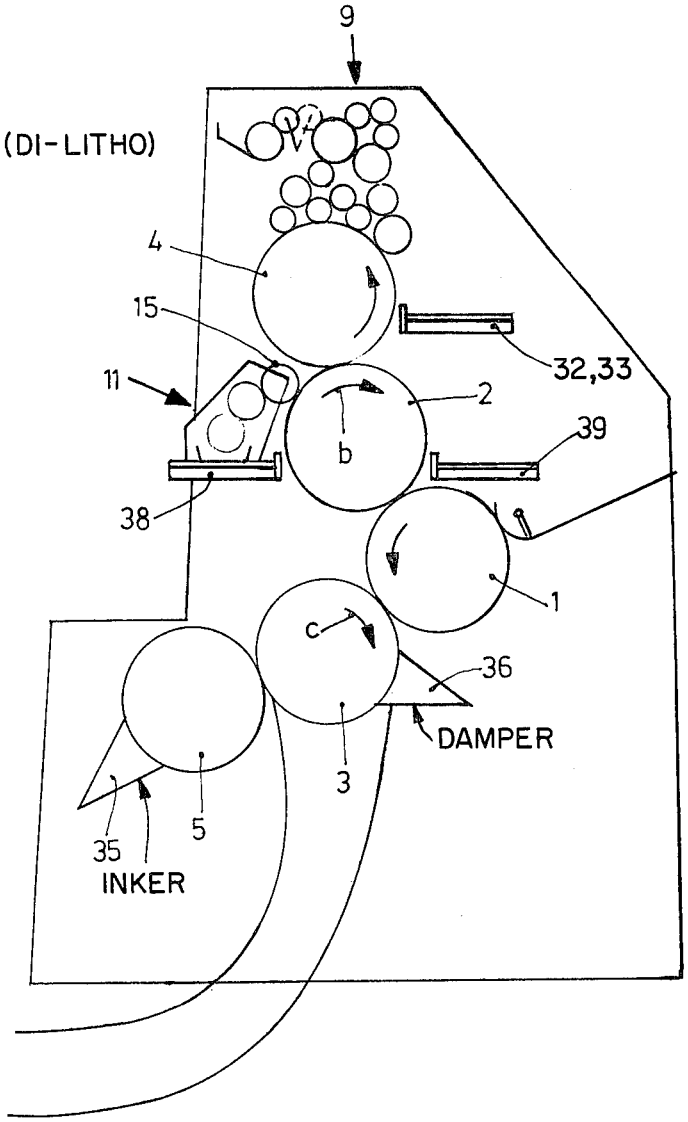
FIG. 2 is a side view of the machine of FIG. 1, set up for direct lithography (DiLitho) printing.

DiLitho Mode, FIG. 2: The damper 11 is removed from the rail 32. In accordance with a feature of the invention, a further set of rails 38 is located on the side walls 17, 18 of the machine to receive the damper 11 as a unit. The damper 11, thus, is applied to the second set of rails 38 (FIG. 2). In this mode of operation, the liquid application roller 15 is in engagement with the rubber blanket cylinder 2.

In similar manner, the damper 36 is applied to the blanket cylinder 3. The plate cylinders 4, 5 are coated with a continuous film of ink and thus provide, in effect, a continuous inking surface and form part of the inking system. For example, a rubber blanket may be applied to the plate cylinder. The blanket cylinders 2, 3 have a direct lithographic printing plate secured thereto.

The set of rails 38 is so arranged that the application roller 15 of the damper 11 contacts the circumference of the blanket cylinder 2 between the printing or impression line thereof, with respect to the impression cylinder 1, and the contact line of the plate cylinder 4, looked at in the direction of the arrow b. Similarly, the damper 36, again looked at in the direction of the arrow c, is positioned between the impression line between the blanket cylinder 3 and the impression cylinder 1 and the contact line between the blanket cylinder 3 and the plate cylinder 5. Consequently, in operation, the DiLitho plate on the blanket cylinder 2 is first wetted by the damper and thereafter inked by the plate cylinder 4. Similarly, the DiLitho plate on the blanket cylinder 3 is first wetted and then inked. Thereafter, printing is effected between the blanket cylinder 2 and the impression cylinder 1 in one color ink, and between the blanket cylinder 3 and the impression cylinder 1 with another color, for example.

Figure 3:
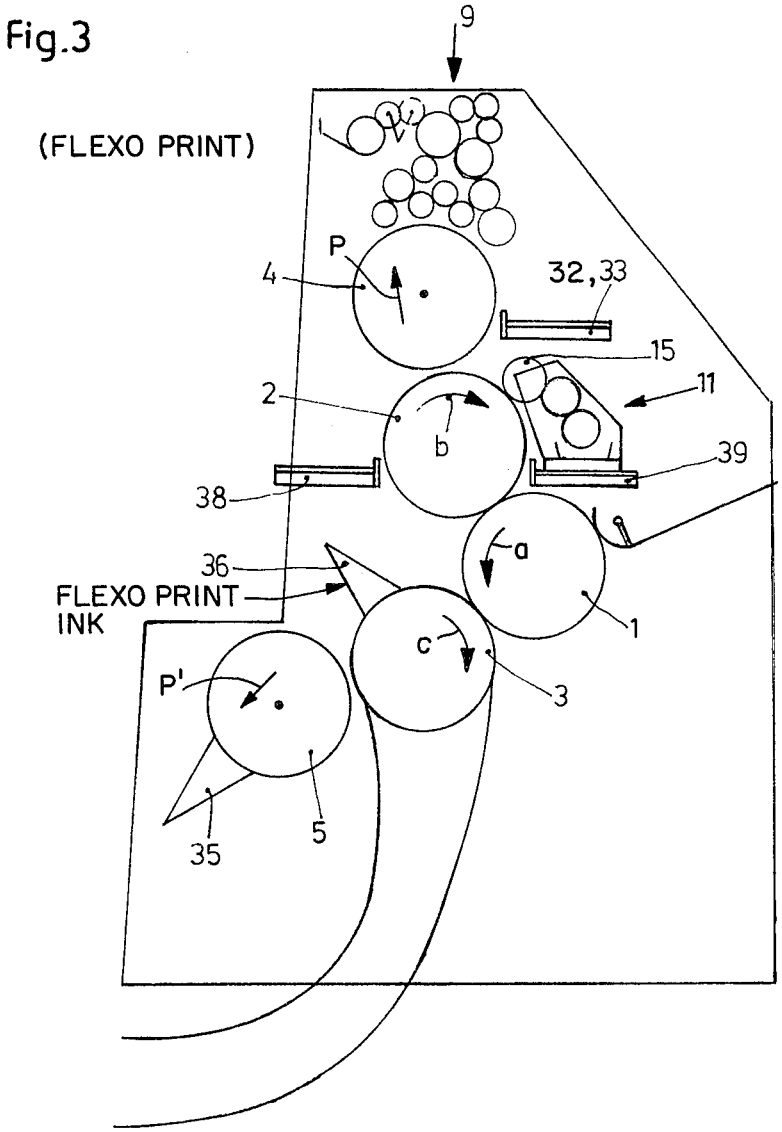
FIG. 3 is a side view of the machine of FIG. 1 set up for flexo printing.

Flexo Printing with Reference to FIG. 3: In accordance with a feature of the invention, a third set of rails 39 is secured to the side walls of the machine 17, 18. The third set of rails is used to locate the damper 11 when flexo printing is desired. The liquid application roller 15 is engaged with the blanket cylinder 2. Similarly, the damper 36 is engaged with the blanket cylinder 3. Contrary to the position for DiLitho printing, however, the application roller 15 is so positioned that it is as close as possible to the printing or impression line with the impression cylinder 1. The plate cylinders 4, 5 are removed from contact with the blanket cylinders 2, 3, for example by rocking the centers of rotation of the respective shafts by a link, an eccenter, or the like as schematically shown by arrows P, P'.

The blanket cylinders 2, 3 each have a flexo printing plate secured thereto. The damping liquid is removed from the trough 12 of the damping system and flexo printing ink is placed therein. The set of rails 39 is so arranged that the application roller 15 of the system 11 contacts the circumference of the blanket cylinder 2, looked at in the direction of rotation of arrow b, between the zone close to the plate cylinder 4 and the impression line of the printing cylinder 1.

The arrangement of the damping, or liquid application system 11, as described, permits application of flexo printing ink shortly before the flexo printing plate on the plate cylinder 2 reaches the impression line with the impression cylinder 1, so that drying of the rapidly drying flexo ink on the plate of the blanket cylinder 2 is prevented.

Similarly, the liquid application system 36 with respect to the lower printing system is repositioned as shown in FIG. 3, so that the blanket cylinder 3, which will have a flexo printing plate applied thereto, will have flexo printing ink applied thereon shortly before reaching the impression line with the impression cylinder 1. Printing is effected in two-color prime printing.

Various changes and modifications may be made, and the modes of printing operation can be selected as desired; for example, different modes of printing can be used for different colors being applied. For example, a blanket cylinder 3 may have a DiLitho plate applied thereto, and the blanket cylinder 2 a flexo printing plate, each one of the respective cylinders 2, 3 being operated in accordance with the appropriate printing mode.

It is obvious that the system, as described, can also be used with a three-cylinder printing system which, for example, only includes the impression cylinder 1, a blanket cylinder 2, and a plate cylinder 4. Further, of course, it is also possible to apply the invention to a four-cylinder printing system in which the two blanket cylinders 2, 3 are in engagement with each other which apply, respectively, prime and verso printing at the same time.

The type of substrate on which printing is to be effected can be as selected, and the machine is equally applicable for sheet printing or for continuous web printing.

Various changes and modifications may be made within the scope of the inventive concept.

I claim:

1. Multiple printing mode rotary printing machine system for selectively printing in (a) offset printing mode;

(b) direct lithographic printing mode;

(c) flexographic printing mode, having two side walls (17, 18);

a blanket cylinder (2, 3) located between the side walls;

cylinder means (1) for forming a printing or impression cylinder and defining, with the blanket cylinder, a printing line;

a plate cylinder (4, 5) located and retained between the side walls adjacent the blanket cylinder (2, 3), said plate cylinder being movable into and out of engagement with the adjacent blanket cylinder;

an inker (9) selectively engageable with the plate cylinder;

and a liquid application system (11)

wherein, in accordance with the invention, the liquid application system (11) is a film system having a liquid trough (12), a pickup roller (13) at least in part located in the trough, a liquid transfer roller (14), and a liquid application roller (15);

and first, second and third individual positioning and support means (32, 33; 38; 39) are provided, located on said side walls for selectively positioning and supporting said liquid application system in accordance with a selected mode of printing of the machine, comprising (a) for offset printing: the first support means (32, 33) being located for, and supporting the liquid application system adjacent to and in liquid transfer contact with said plate cylinder (4, 5) in advance—with respect to the direction of rotation (a) of the plate cylinder—of the inker (9);

and wherein the liquid in the liquid trough comprises damping liquid;

(b) for direct lithographic printing: the second support means (38) being located for and supporting said liquid application system adjacent to and in liquid transfer contact with said blanket cylinder (2, 3) in advance—with respect to the direction of rotation (b) of the blanket cylinder—of said plate cylinder (4, 5);

wherein the liquid in the liquid trough comprises damping liquid; and wherein said plate cylinder supplies ink to the blanket cylinder from the inker;

(c) for flexo printing: the third support means (39), being located for and supporting said liquid application system adjacent to and in liquid transfer contact with said blanket cylinder (2, 3) in advance—with respect to the direction of rotation (b) of the blanket cylinder—of the printing line and in the zone adjacent the blanket cylinder between the plate cylinder and said printing line;

wherein the liquid in the liquid trough (12) comprises flexo printing ink; and wherein said plate cylinder is out of contact with the blanket cylinder, the blanket cylinder carries a flexo printing plate.

2. Printing machine system according to claim 1, wherein said first, second and third positioning means comprise rails (32, 33; 38, 39) for selective placement of the liquid application system (11) thereon.

3. Printing machine system according to claim 1, further comprising a carrier structure (16) supporting the liquid application system as a unit;

and an individual drive motor (29) secured to the carrier structure.

4. Printing machine system according to claim 3, where the first, second and third support means (32, 33; 38, 39) comprise rails and said support structure (16) is secured to said rails.

5. Printing machine system according to claim 3, wherein two plate elements (19, 20) are secured to said support structure (16), extending parallel to the side walls (17, 18) when the liquid application system is located on any one of said positioning and support means;

and wherein the rollers (13, 14, 15) are secured to said parallel plates (19, 20).

6. Printing machine system according to claim 4, further including holding and clamping means (37) for securely attaching and clamping the support structure (16) to the respective rails.

7. Printing machine system according to claim 2, further including position adjustment means (35) secured to said rails for providing an adjustable abutment for the liquid application system (11) on the rails to permit adjustable reproducible positioning of the liquid application system on the rails and for liquid transfer contact of the respective cylinder with the liquid application roller (15) of the liquid application system upon selective placement of the system on any one of said positioning support means.

8. Printing machine system according to claim 4, further including position adjustment means (35) secured to said rails for providing an adjustable abutment for the liquid application system (11) on the rails to permit adjustable reproducible positioning of the liquid application system on the rails and for liquid transfer contact of the respective cylinder with the liquid application roller (15) of the liquid application system upon selective placement of the system on any one of said positioning support means.

* * * * *